US012654898B2

(12) United States Patent
Chupak et al.

(10) Patent No.: US 12,654,898 B2
(45) Date of Patent: Jun. 16, 2026

(54) BOTTLE NECK WITH PROTRUSIONS FOR FASTENING A THREADED CAP

(71) Applicant: TRIVIUM PACKAGING, Youngstown, OH (US)

(72) Inventors: Thomas Chupak, West Middlesex, PA (US); Mark Sanders, Hubbard, OH (US)

(73) Assignee: Trivium Packaging, Youngstown, OH (US)

( * ) Notice: Subject to any disclaimer, the term of this patent is extended or adjusted under 35 U.S.C. 154(b) by 0 days.

(21) Appl. No.: 17/885,059

(22) Filed: Aug. 10, 2022

(65) Prior Publication Data

US 2023/0046937 A1 Feb. 16, 2023

Related U.S. Application Data

(60) Provisional application No. 63/231,450, filed on Aug. 10, 2021.

(51) Int. Cl.
*B65D 1/02* (2006.01)
*B65D 41/04* (2006.01)

(52) U.S. Cl.
CPC ..... *B65D 1/0246* (2013.01); *B65D 41/04* (2013.01)

(58) Field of Classification Search
CPC ..... B65D 41/04; B65D 2251/023; B65D 2543/00092; B65D 2543/00296; B65D 2215/02
USPC ..... 215/220, 329; 220/288, 259.4, 296, 298, 220/300; 222/552, 546, 548
See application file for complete search history.

(56) References Cited

U.S. PATENT DOCUMENTS 3,622,041 A * 11/1971 Borsum ..... B65D 51/24 221/202
3,675,804 A * 7/1972 Micalief ..... B65D 50/04 215/217
3,690,495 A * 9/1972 Turner ..... B65D 50/041 215/220
3,771,685 A * 11/1973 Micallef ..... B65D 50/04 215/220
3,797,688 A * 3/1974 Porcelli ..... B65D 50/041 215/220
4,284,201 A * 8/1981 Nixon ..... B65D 50/041 215/220

(Continued)

FOREIGN PATENT DOCUMENTS

EP 1069049 A2 * 1/2001 ..... B65D 51/20

OTHER PUBLICATIONS

Form PCT/ISA/220, PCT Notification of Transmittal of the International Search Report and the Written Opinion of the International Searching Authority, or the Declaration, PCT/US2022/039948, Date Mailed Nov. 1, 2022.

(Continued)

*Primary Examiner* — Steven A. Reynolds
*Assistant Examiner* — Prince Pal
(74) *Attorney, Agent, or Firm* — Paul D. Bangor, Jr., Esq.; Clark Hill PLC

(57) ABSTRACT

A bottle comprising: a body having a closed bottom and an open neck; a plurality of protrusions extending outward radially from an outer surface of the neck; a cap having internal threads for screwing onto the open neck; wherein the internal threads engage the plurality of protrusions when the cap is screwed onto the neck.

1 Claim, 3 Drawing Sheets

(56) References Cited

U.S. PATENT DOCUMENTS 4,519,514 A * 5/1985 Agbay ..... B65D 50/06 215/221
5,020,682 A * 6/1991 Dutt ..... B65D 41/0471 215/217
5,458,113 A * 10/1995 Burns ..... A61B 5/150343 422/547
5,947,318 A * 9/1999 Palm ..... B65D 51/222 222/541.2
6,234,338 B1 * 5/2001 Searle ..... B65D 51/145 220/366.1
6,311,861 B1 * 11/2001 Policappelli ..... B65D 1/16 220/669
6,375,020 B1 * 4/2002 Marquez ..... B65D 1/0246 215/232
6,520,387 B2 * 2/2003 Soehnlen ..... B65D 47/32 220/366.1
6,732,878 B2 * 5/2004 Gillen ..... B65D 90/34 220/582
8,006,852 B1 * 8/2011 Miceli ..... B65D 50/066 215/221
8,245,860 B2 * 8/2012 Farrar ..... B65D 41/08 215/222
8,636,167 B2 * 1/2014 Hajichristou ..... B65D 50/061 220/230
8,746,485 B1 * 6/2014 Tiefenthaler ..... B60K 15/0406 220/255
8,985,371 B2 * 3/2015 Zabaleta ..... B65D 17/401 220/284
9,233,772 B2 * 1/2016 Kuzma ..... B65D 1/0246
9,637,269 B1 * 5/2017 Zabaleta ..... B65D 17/4014
10,160,566 B2 * 12/2018 McKenzie ..... B65D 1/0246
10,968,010 B1 * 4/2021 Zabaleta ..... B65D 17/401
11,046,486 B2 * 6/2021 Hwang ..... B65D 50/04
11,542,067 B2 * 1/2023 Forrest ..... B65D 50/046
2002/0003154 A1 * 1/2002 Soehnlen ..... B65D 47/246 222/552
2005/0121406 A1 * 6/2005 Brozell ..... B65D 50/043 215/220
2007/0045319 A1 * 3/2007 Hogan ..... B65D 50/041 215/331
2008/0053949 A1 * 3/2008 Farrar ..... B65D 41/086 215/332
2008/0257849 A1 * 10/2008 Farrar ..... B65D 39/10 215/44
2008/0314856 A1 12/2008 Penny et al.
2009/0107948 A1 * 4/2009 Brand ..... A61J 1/1406 215/247
2009/0188888 A1 * 7/2009 Penny ..... B65D 1/0246 215/382
2011/0100947 A1 * 5/2011 Long ..... B65D 41/3414 215/220
2013/0075356 A1 * 3/2013 Bergida ..... A47G 19/2205 215/230
2014/0042164 A1 * 2/2014 Zabaleta ..... B65D 41/32 220/267
2015/0076103 A1 * 3/2015 Koller ..... B65D 50/046 215/220
2015/0246755 A1 * 9/2015 Wang ..... B65D 50/043 215/220
2015/0298866 A1 * 10/2015 Hagen ..... B65D 43/0225 220/288
2015/0375886 A1 * 12/2015 Kraft ..... B65D 1/0246 215/44
2017/0001763 A1 * 1/2017 Hu ..... B65D 53/04
2018/0279815 A1 * 10/2018 Hakim ..... B65D 47/32
2019/0216264 A1 * 7/2019 Adams, Jr. ..... A47J 41/0011
2020/0198857 A1 * 6/2020 Riedel ..... B65D 41/0471
2020/0407123 A1 * 12/2020 Adams, Jr. ..... B65D 53/00
2021/0316914 A1 * 10/2021 Tidwell ..... B65D 35/44
2023/0046937 A1 * 2/2023 Chupak ..... B65D 41/04
2023/0227224 A1 * 7/2023 Bobb ..... B65D 50/061 215/44

OTHER PUBLICATIONS

Form PCT/ISA/210, PCT International Search Report for International Application No. PCT/US2022/039948, Date Mailed Nov. 1, 2022.

Form PCT/ISA/237, PCT Written Opinion of the International Searching Authority for International Application No. PCT/US2022/039948, Date Mailed Nov. 1, 2022.

* cited by examiner

DETAIL A
Section View

BOTTLE NECK WITH PROTRUSIONS FOR FASTENING A THREADED CAP

RELATED APPLICATION

This application claims priority benefit under 35 U.S.C. § 119(e) of U.S. Provisional Application No. 63/231,450 filed Aug. 10, 2021 the contents of which are herein incorporated by reference.

FIELD OF THE DISCLOSURE

Technical Field

The present disclosure generally relates to the field of bottles with closure systems wherein the bottles and closures are made of aluminum, steel, other metal(s) and/or plastic.

BACKGROUND OF THE DISCLOSURE

The present disclosure relates to an improved bottle with a closure system wherein the bottle and closure are made of aluminum, steel, other metal(s) and/or plastic. According to the present disclosure, a preferred bottle has a neck with one or more protrusions extending outwardly therefrom onto which a conventional threaded closure cap can be installed. Thus, the bottle of the present disclosure eliminates the need for a threaded neck and greatly reduces the costly capital investment for rotational threading devices that would otherwise be needed to thread the neck of the bottle.

BRIEF SUMMARY OF THE DISCLOSURE

In a preferred aspect, the present disclosure comprises a bottle comprising: a body having a closed bottom and an open neck; a plurality of protrusions extending outward radially from an outer surface of the neck; a cap having internal threads for screwing onto the open neck; wherein the internal threads engage the plurality of protrusions when the cap is screwed onto the neck.

In another preferred aspect of a bottle of the present disclosure, the protrusions are spaced equally around a circumference of the outer surface of the neck.

In yet another preferred aspect of a bottle of the present disclosure, each of the plurality of protrusions is located the same distance from a top of the bottle as each of the other ones of the plurality of protrusions.

In another preferred aspect of a bottle of the present disclosure, the plurality of protrusions extending outward radially from the outer surface of the neck consists of two, three or four protrusions spaced equally around a circumference of the outer surface of the neck.

In an additional preferred aspect of a bottle of the present disclosure, each of the plurality of protrusions is located a different distance from a top of the bottle as each of the other ones of the plurality of protrusions.

In yet another preferred aspect of a bottle of the present disclosure, the plurality of protrusions extending outward radially from the outer surface of the neck consists of two, three or four protrusions spaced equally around a circumference of the outer surface of the neck.

In another preferred aspect of a bottle of the present disclosure, each of the plurality of protrusions extends outward radially from the outer surface of the neck about 1-3 mm.

In a further preferred aspect of a bottle of the present disclosure, each of the plurality of protrusions extends outward radially from the outer surface of the neck about 1 mm.

In another preferred aspect of a bottle of the present disclosure, each of the plurality of protrusions are frusto-conical, spherical or cylindrical in shape and have a diameter of about 1-5 mm.

In yet another preferred aspect of a bottle of the present disclosure, the protrusions are spaced-apart around a circumference of an outer surface of neck along a helical path corresponding to the threads to allow the plurality of protrusions to engage the threads to the secure cap onto the neck.

DETAILED DESCRIPTION

In the following "Detailed Description" of the present disclosure, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "disclosure" merely for convenience and without intending to voluntarily limit the scope of this application to any single inventive concept if more than one is in fact disclosed.

The following Detailed Description is, therefore, not to be taken in a limited sense, and the scope of the inventive subject matter is defined by the appended claims and their equivalents.

Figure 1:
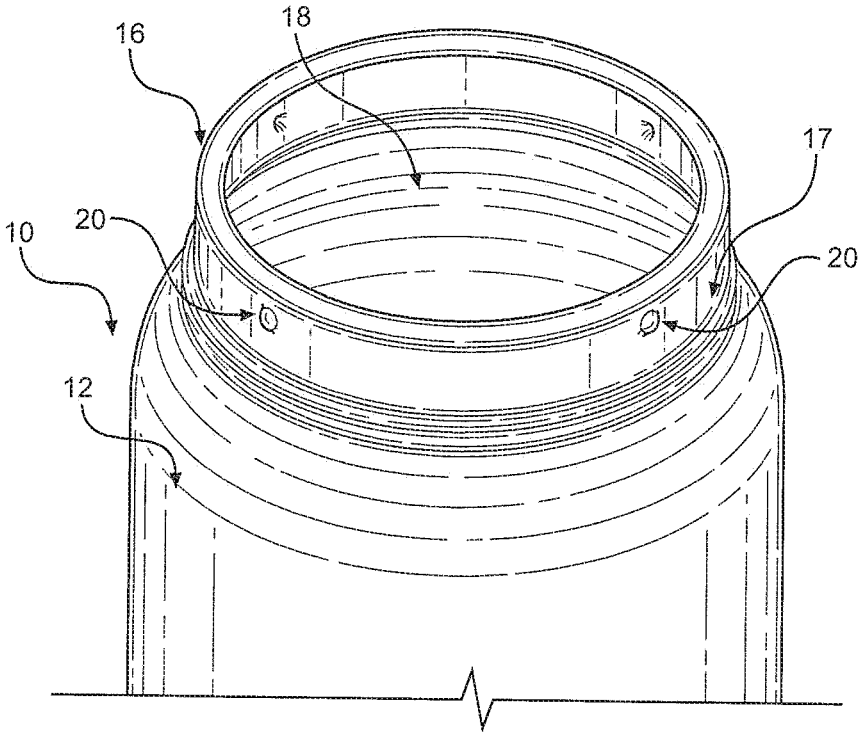
FIG. 1 shows a top perspective view of a preferred embodiment of a bottle having a plurality of protrusions extending outward radially from an outer surface of the neck of the bottle according to the present disclosure.
Figure 2:
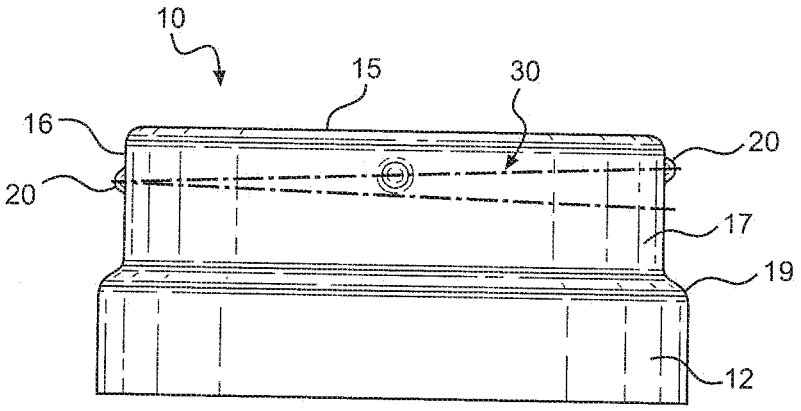
FIG. 2 shows a side elevation view of the bottle of FIG. 1.
Figure 3:
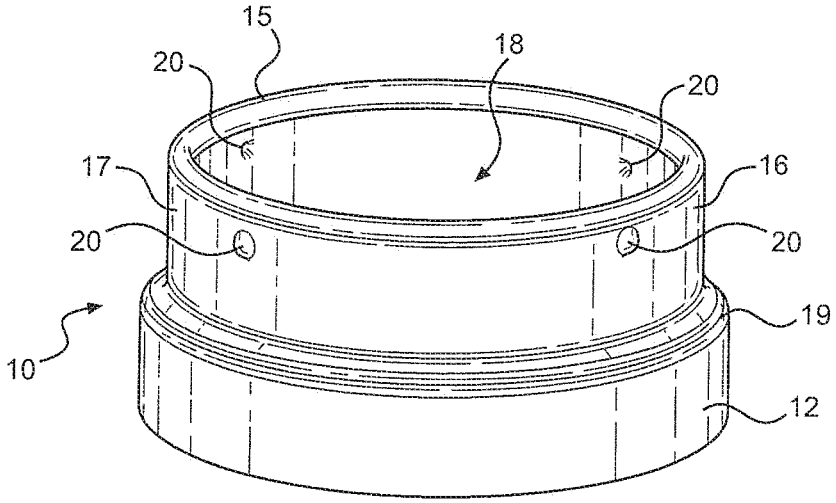
FIG. 3 shows another top perspective view of the bottle of FIG. 1.
Figure 4:
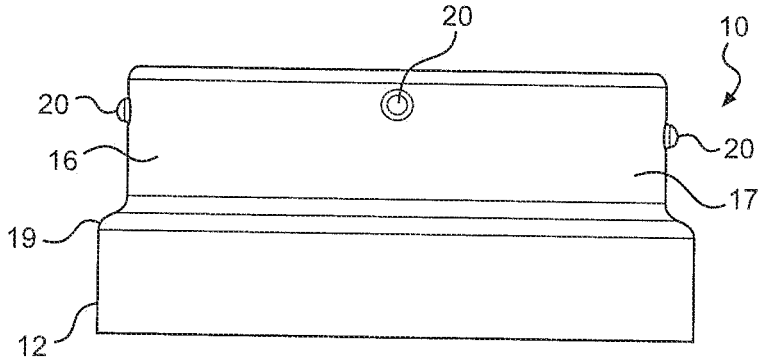
FIG. 4 shows another side elevation view of the bottle of FIG. 1.
Figure 5:
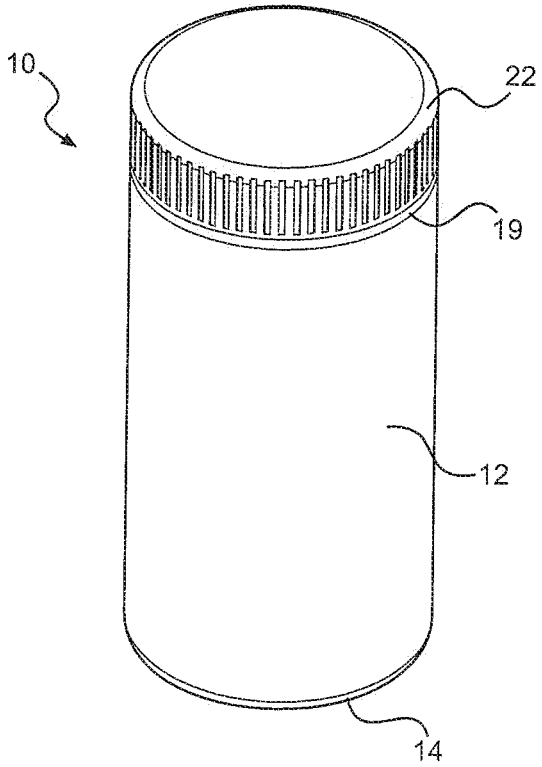
FIG. 5 shows a top perspective view of a preferred embodiment of a bottle having a plurality of protrusions extending outward radially from an outer surface of the neck of the bottle and a cap installed thereon according to the present disclosure.
Figure 6:
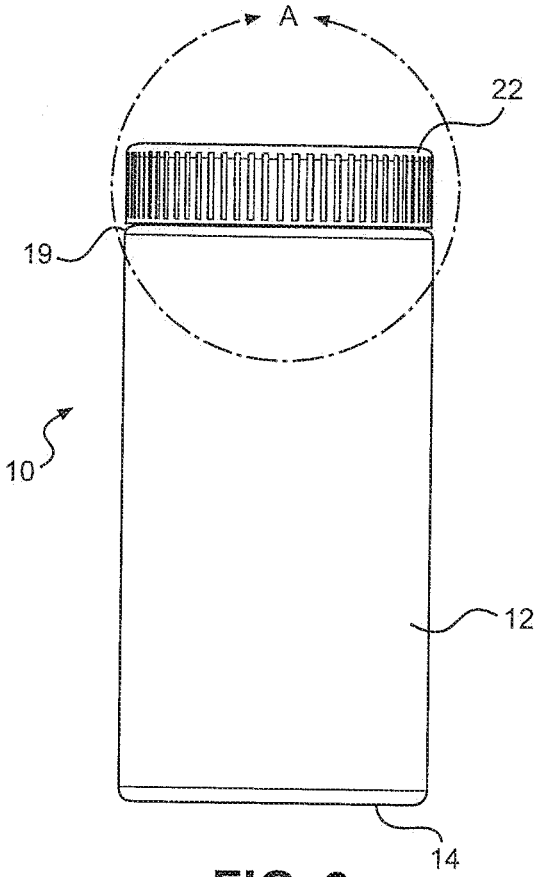
FIG. 6 shows a side elevation view of the bottle of FIG. 5.
Figure 7:
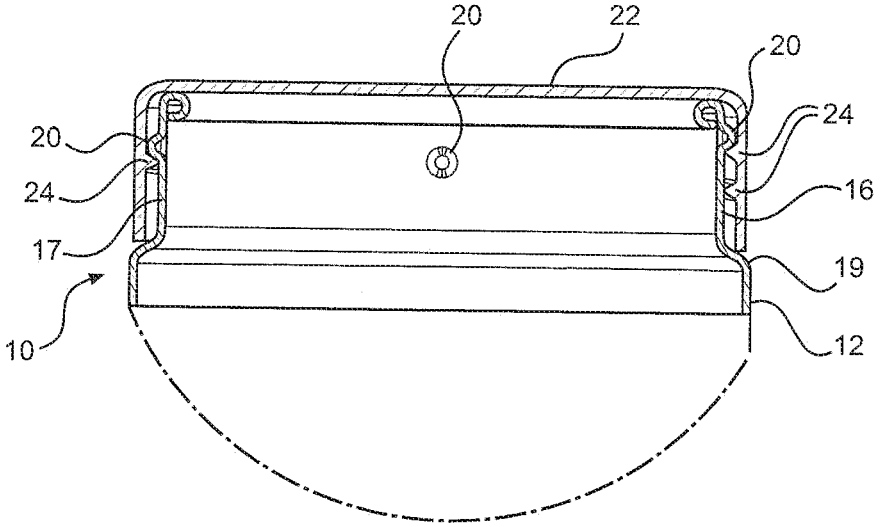
FIG. 7 shows a partial cross-sectional view of the bottle of FIG. 6 within Area "A".

As shown in FIG. 1, the present disclosure is directed to a bottle 10 having a body 12 having a closed bottom 14, an open neck 16 defining opening 18 and a shoulder 19 disposed between body 12 and neck 16. Neck 16 defines a plurality of protrusions or dimples 20 extending outward radially from an outer surface 17 of neck 16. Bottle 10 preferably includes a cap 22 having internal threads 24 for screwing onto the open neck 16 wherein the internal threads 24 engage the plurality of protrusions 20 when the cap 22 is screwed onto the neck 16.

Because neck 16 with protrusions 20 eliminates threads it greatly reduces the costly capital investment of rotational threading devices that would otherwise be needed to thread neck 16. Cap 22 preferably is a standard off-the-shelf threaded closure, Child Resistant Closure (CRC) or a custom threaded closure having threading 24 with a pitch in the range of 1 mm to 10 mm or having about 6-8 threads per inch.

Preferably, the plurality of protrusions 20 are spaced equally around a circumference of the outer surface 17 of neck 16. Also, preferably, the plurality of protrusions 20 are spaced equally around a circumference of the outer surface 17 of neck 16 along a helical path 30 corresponding to the threads 24 that allows the protrusions 20 to engage threads 24 to secure cap 22 onto neck 16 of bottle 10.

Additionally, each of the plurality of protrusions 20 is preferably located the same distance, different distances or varying distances from the top 15 of the bottle 10 as each of the other ones of the plurality of protrusions 20. The number of protrusions 20 used preferably may vary depending on the height of cap 22 and/or the number of threads 24 on the inside of cap 22. Typically, the number of protrusions 20 used extending outward radially from the outer surface of the neck consists of two, three, four or more.

Preferably, each of the plurality of protrusions 20 is frustoconical, spherical or cylindrical in shape and has a diameter of about 1 mm to 5 mm at its base depending upon the pitch of threads 24 of cap 22. More preferably, each of the plurality of protrusions 20 has a diameter of about 1.8 mm at its base. Additionally, each of the plurality of protrusions 20 is extends outward radially from the outer surface 17 of neck 16 about 1-3 mm and, more preferably, about 1 mm.

Preferably, bottle 10 may define virtually any shape, profile and/or size inclusive of the diameter and profile of neck 16 and shoulder 19 of bottle 10. In addition, bottle 10 is preferably made of aluminum, steel, other metal(s) or plastic.

In the foregoing Detailed Description, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A bottle comprising:

a body having a closed bottom and an open neck;

a plurality of protrusions extending outward radially from an outer surface of the open neck, wherein the plurality of protrusions extending outward radially from the outer surface of the open neck consists only of two protrusions spaced equally or non-equally around a circumference of the outer surface of the open neck;

wherein each of the plurality of protrusions consisting only of two protrusions has a base and a diameter of about 1-2 mm at the base;

wherein each of the plurality of protrusions consisting only of two protrusions extends outward radially from the outer surface of the open neck about 1-2 mm;

a cap having internal threads for screwing onto the open neck;

wherein the plurality of protrusions consisting only of two protrusions are spaced-apart around a circumference of the outer surface of the open neck along a helical path corresponding to the internal threads of the cap to allow the plurality of protrusions consisting only of two protrusions to engage the threads to secure the cap onto the open neck.

* * * * *